US008177650B1

(12) United States Patent
Tasi

(10) Patent No.: US 8,177,650 B1
(45) Date of Patent: May 15, 2012

(54) BILLIARD EQUIPMENT STORAGE STRUCTURE

(76) Inventor: Te-Yao Tasi, Taipei (TW)

( * ) Notice: Subject to any disclaimer, the term of this patent is extended or adjusted under 35 U.S.C. 154(b) by 0 days.

(21) Appl. No.: 13/244,512

(22) Filed: Sep. 25, 2011

(51) Int. Cl.
*A63D 15/00* (2006.01)

(52) U.S. Cl. ..... 473/1; 473/4; 473/10; 473/33

(58) Field of Classification Search ..... 473/1, 4, 473/10, 14, 15, 33, 41
See application file for complete search history.

(56) References Cited

U.S. PATENT DOCUMENTS

| | | | | | |
|---|---|---|---|---|---|
| 193,156 | A * | 7/1877 | Gardner | 473/10 |
| 385,346 | A * | 7/1888 | Flint | 473/10 |
| 815,228 | A * | 3/1906 | Stone | 473/10 |
| 1,755,062 | A * | 4/1930 | Hernes et al. | 273/118 R |
| 2,008,613 | A * | 7/1935 | Hernes | 108/90 |
| 3,341,198 | A * | 9/1967 | Turpin, Sr. | 473/10 |
| 3,913,973 | A * | 10/1975 | Mintz et al. | 473/10 |
| 6,349,939 | B1 * | 2/2002 | Tsai | 273/108.1 |
| 6,502,819 | B2 * | 1/2003 | Rieber et al. | 273/126 R |
| 6,616,141 | B2 * | 9/2003 | Diamant | 273/108.1 |
| 6,712,711 | B1 * | 3/2004 | Skelton et al. | 473/10 |
| 7,621,818 | B1 * | 11/2009 | Tippit | 473/10 |
| 8,033,923 | B2 * | 10/2011 | Chung | 473/14 |
| 2005/0049056 | A1 * | 3/2005 | Padilla | 473/10 |
| 2005/0064945 | A1 * | 3/2005 | Voden | 473/10 |
| 2005/0255928 | A1 * | 11/2005 | Nally | 473/10 |

* cited by examiner

*Primary Examiner* — Mitra Aryanpour

(57) ABSTRACT

A billiard equipment storage structure, mainly includes: a bearing bracket, including a receiving space with a hand pulling portion; and a foldable extension mechanism, including two movable frames opposite to each other. Each movable frame has a upper fixing plate, a foldable stretching arm and a lower fixing plate coupled to each other in sequence, where the upper fixing plate is configured under a billiard table, and the lower fixing plate is connected to the bearing bracket. Whereby, the storage structure can be folded and suspended to hide under the billiard table, receive billiard equipment neatly so as to save storage space, and achieve the complete protection of billiard equipment and the convenience of taking them out for play anytime.

4 Claims, 4 Drawing Sheets

BILLIARD EQUIPMENT STORAGE STRUCTURE

BACKGROUND OF THE INVENTION

1. Field of the Invention

The present invention relates to a billiard equipment storage structure, and more particularly to a storage structure that can be folded and suspended to hide under a billiard table, in which billiard equipment can be received neatly, thereby saving storage space and protecting billiard equipment completely and being convent to take them out for play.

2. Background

Generally speaking, billiard is a popular leisure entertainment and game; it is because a novice can handle it very quickly. A player can play it by themselves only, or with other persons such that it is a favorite game for most people.

In billiard, accessories such as talcum powder bags, chalks, racks and cue rests are needed besides fundamental articles such as billiard table, balls and billiard cues. However, the current conventionally structured balls, cues and etc are mostly laid aside while being not in use, causing the articles to be lost easily, or needing to build cue rests and prepare a case or receptacle to receive them. Therefore, the main defect thereof is that it consumes space.

In addition, the current cut rests may be roughly divided into two types, i.e. Foot-mounted type and suspension type, and cue placing manners may be divided into a hole passing-through type and press-in type. No matter what type it is, whether a billiard cue is curved and deformed while being placed in a cue rest depends on the quality of the design of the cue rest structure. The axis of a billiard cue must be kept at a very high precision without any curved deformation, otherwise the accuracy of ball shot will be influenced, because the billiard cue is an important required tool in billiard. Therefore, it is necessary to have a well-managed and meticulous planning to a billiard cue rest.

SUMMARY OF THE INVENTION

To improve the defects of conventional structure mentioned above, the present invention is proposed.

The present invention mainly proposes a billiard equipment storage structure, mainly comprising:

a bearing bracket, having a receiving space with a hand pulling portion, and a foldable extension mechanism, having two movable frames opposite to each other, each movable frame having a upper fixing plate, foldable stretching arm, and a lower fixing plate coupled to each other in sequence, the fixing plate being configured under a billiard table and the lower fixing plate being connected to the bearing bracket.

Whereby, the storage structure of the present invention can be folded and suspended to hide under a billiard table, allowing billiard equipment to be received neatly so as to saving storing space, and achieving the protection of billiard equipment and the convenience of taking billiard equipment out for play.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Referring to FIGS. 1 to 4, a billiard equipment storage structure 1 mainly includes a bearing seat 2, and a foldable extension mechanism 3

Figure 4:
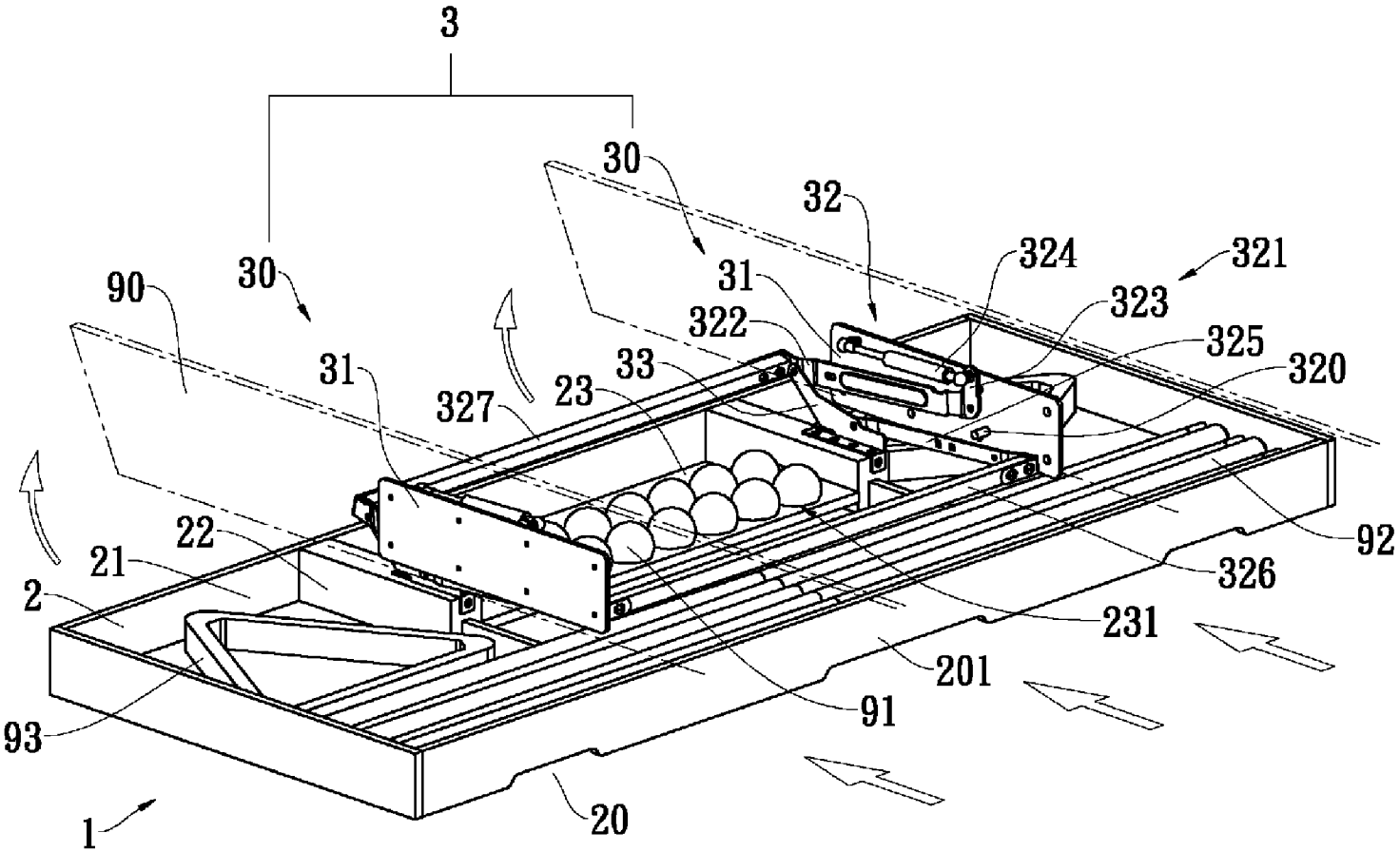
FIG. 4 is a perspective view of a storage structure in which billiard equipment is received according to the present invention.

The bearing bracket 2 has a receiving space 21 with a hand pulling portion 20, where a fixing seat 22 is respectively configured distantly on two sides inside the receiving space 21, where a transverse plate 23 is configured between the two fixing seats 22. A plurality of circular holes 231 for receiving billiard balls 91 are disposed on the transverse plate 23 as FIG. 4 shows. Furthermore, a partition plate 24 on which a plurality of engagement grooves 241 is disposed is respectively disposed on the front ends of the two fixing seats 22 for receiving billiard cues 92 as FIG. 4 shows. In addition, the aforementioned hand pulling portion 20 may be constituted by a through hole 201 disposed on the bottom of the receiving space 21.

Figure 1:
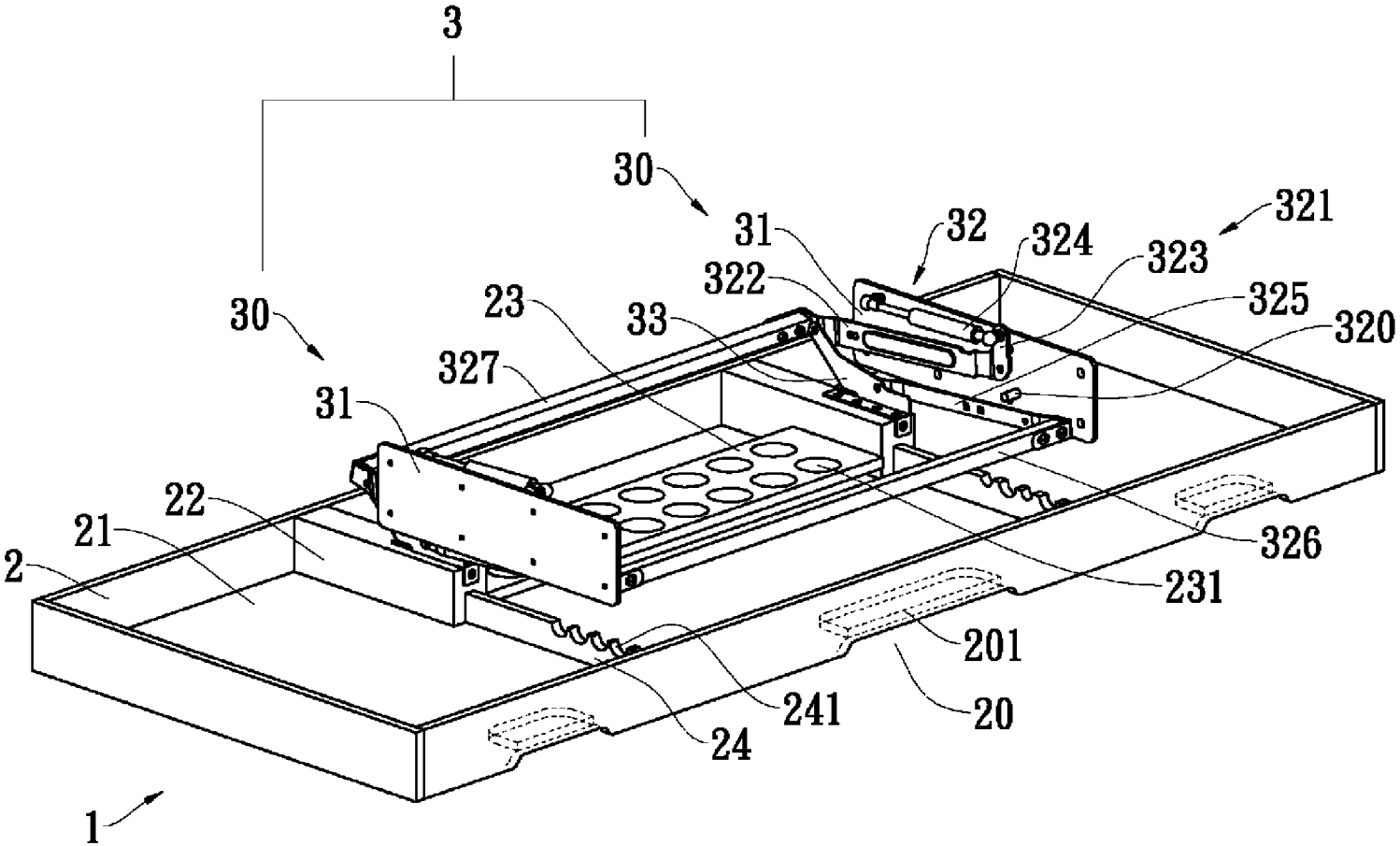
FIG. 1 is a perspective view of a storage structure according to the present invention.
Figure 2:
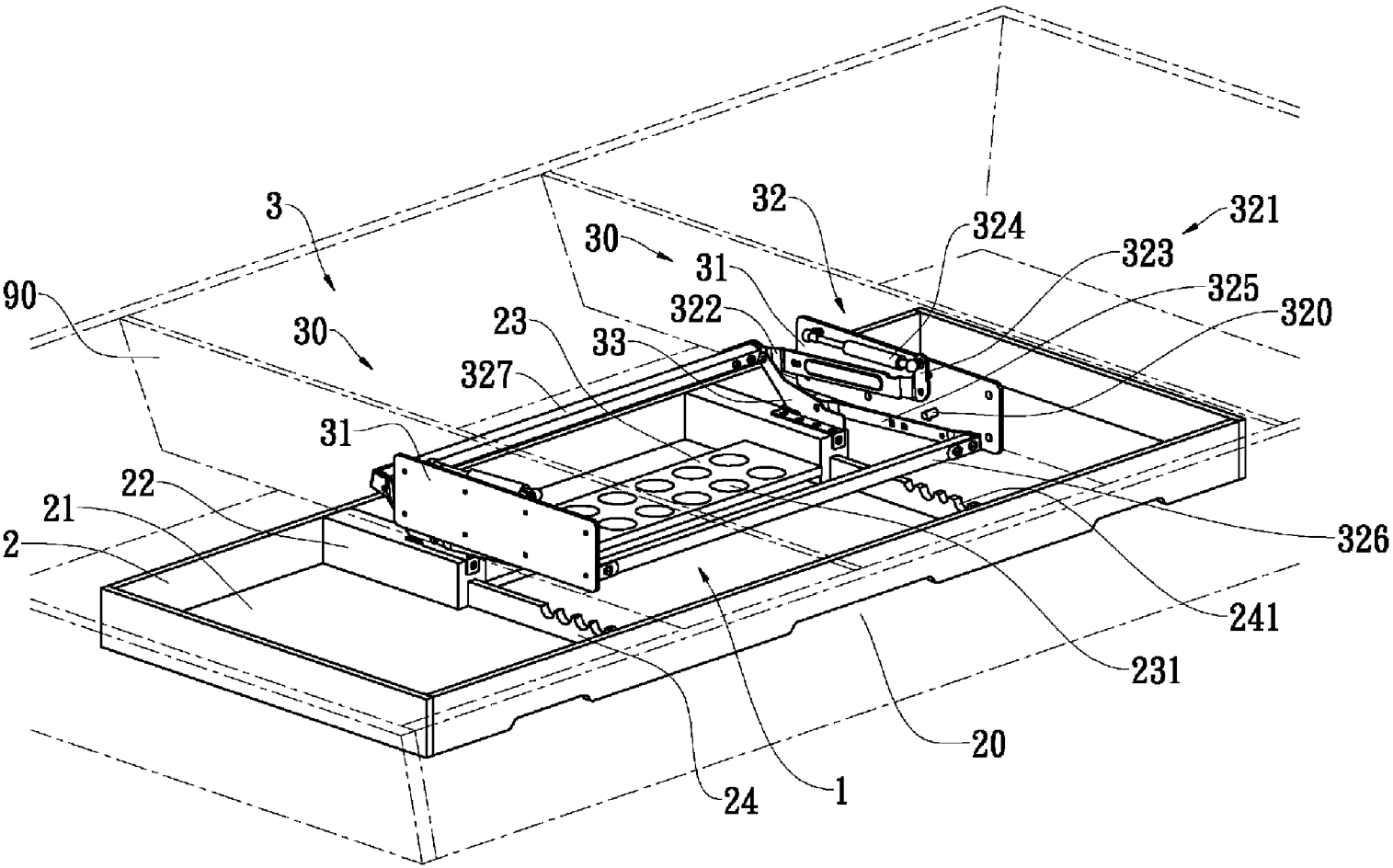
FIG. 2 is a perspective view of a storage structure coupled to a billiard table according to the present invention.

A foldable extension mechanism 3 includes two movable frames 30 opposite to each other, where each movable frame 30 has a upper fixing plate 31, a foldable stretching arm 32 and a lower fixing plate 33 connected to each other in sequence. The upper fixing plate 31 for locking under a billiard table 90 is a rectangular plate as FIG. 2 shows. The lower fixing plate 33 for locking to the fixing seat 22 of the bearing bracket 2 is a curved plate. Furthermore, the two ends of the foldable stretching arm 32 are respectively coupled pivotally to the upper fixing plate 31 and the lower fixing plate 33 such that the foldable stretching arm 32 is disposed between them. In addition, a position limiting convex 320 is disposed on the side of the upper fixing plate 31 opposite to the foldable stretching arm 32.

Furthermore, the foldable stretching arm 32 may further comprise a main arm 321 and an auxiliary arm 325, where the main arm 321 has a long rod 322 with one end thereof coupled to the lower fixing plate 33 and another end thereof coupled pivotally to one end of a short rod 323, and another end of the short rod 323 is coupled to a cushion cylinder shaft 324 and configured on the upper fixing plate 31. The auxiliary arm 325 is parallel to the main arm 321, one end thereof is coupled pivotally to the upper fixing plate 31 and another end thereof is coupled pivotally to the lower fixing plate 33. Furthermore, cross rods 326, 327 are respectively configured between the two auxiliary arms 325 and between the two long rods 322, and respectively coupled thereto.

Thereupon, the storage structure 1 of the present invention can be folded and suspended to hide under the billiard table so as to save storage space while being not in use as FIG. 2 shows, the bearing bracket 2 can be pulled to move through the hand pulling portion 20 to further affect the foldable stretching mechanism 3 to function, allowing the bearing bracket 2 hidden under the billiard table 90 originally to be pulled and exposed out of the billiard table 90 while being put in use, thereby allowing billiard equipment to be received neatly, achieving the complete protection of billiard equipment and the convenient take-out thereof for play.

Figure 3:
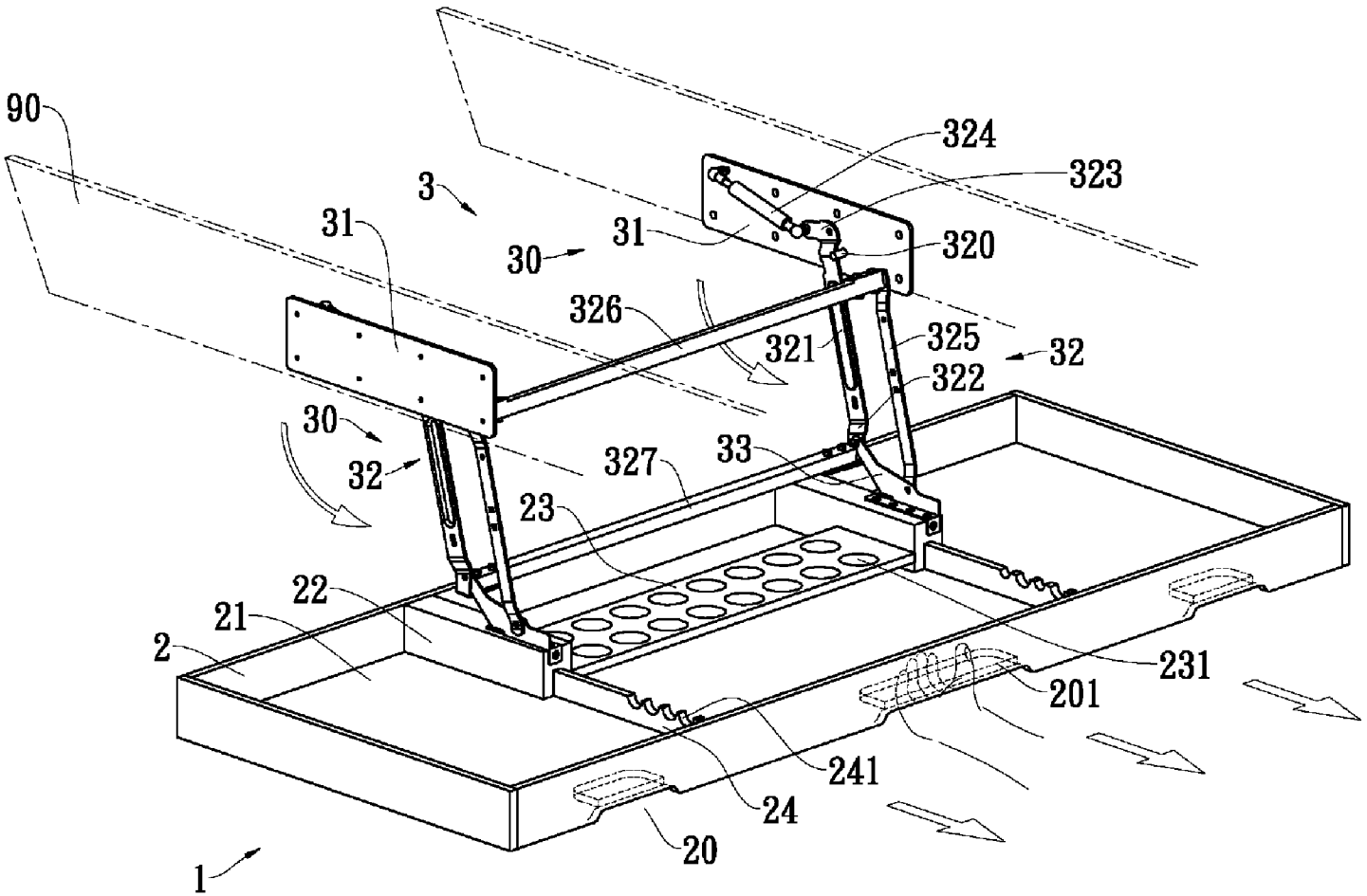
FIG. 3 is a perspective view of a unfolded storage structure according to the present invention.

Referring to FIGS. 3 and 4, the foldable extension mechanism 3 will take the place where the auxiliary arm 325 is coupled to the upper fixing plate 31 as a center of rotation, allowing another end of the auxiliary arm 325 coupled to the lower fixing plate 33 to be in circular motion as well when the bearing bracket 2 is pulled, and at the same time, the main arm 321 is also driven to be in a circular motion, further allowing the long rod 322 of the main arm 321 to be propped against the position limiting convex 320 used as a fulcrum for opening the joints of the foldable stretching arm 32 to cause the short rod 323 to further pull the cushioning cylinder shaft 324 to extend outward, thereby lowering down the bearing bracket 2 and extending it out of the billiard table 90.

Therefore, it is convenient to pull out the bearing bracket 2 to place the separated billiard cue 95 in the engagement grooves 241, the billiard balls 93 in the circular holes 231, and the rack 93, chalks, talcum powder bags and etc respectively in the receiving space 21 after a billiard game is over, and the bearing bracket 2 is pushed back to hide under the billiard table 90, thereby receiving them neatly, completely and protectively. Vice versa, the bearing bracket 2 is pulled out again and the billiard equipment can be taken out one by one easily when a billiard game begins such that the present invention is convenient in operation.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A billiard equipment storage structure, comprising:

a bearing bracket, comprising a receiving space with a hand pulling portion; and a foldable extension mechanism, comprising two movable frames opposite to each other, said each movable frame having an upper fixing plate, a foldable stretching arm and a lower fixing plate coupled to each other in sequence, said upper fixing plate being configured under a billiard table, and lower fixing plate being coupled to said bearing bracket;

whereby, said bearing bracket is folded and suspended to hide under said billiard table, receiving billiard equipment so as to save storage space, achieve the complete protection of said billiard equipment and be convenient to take said billiard equipment out for play.

2. The billiard equipment storage structure according to claim 1, wherein a fixing seat is respectively disposed distantly on two sides inside said receiving space of said bearing bracket, a transverse plate is disposed between said two fixing seats a plurality of circular holes for receiving billiard balls are disposed on said transverse plate, a partition plate is respectively disposed on front ends of said two fixing seats, a plurality of engagement grooves for receiving billiard cues is disposed on said partition plate;

said hand pulling portion is constituted by a through hole disposed on a bottom of said receiving space.

3. The billiard equipment storage structure according to claim 2, wherein a position limiting convex is disposed on a side of said upper fixing plate opposite to said foldable stretching arm; said foldable stretching arm further comprises a main arm and an auxiliary arm, said main arm has a long rod for coupling pivotally to a short rod connected to said lower fixing plate, another end of said short rod is coupled to a cushioning cylinder shaft so as to configure said short rod on said upper fixing plate; said auxiliary arm is parallel to said main arm, one end thereof is coupled pivotally to said upper fixing plate, another end thereof is configured on said lower fixing plate, and a cross rod is respectively configured between said two auxiliary arms and between said two long rods and respectively connected thereto.

4. The billiard equipment storage structure according to claim 3, wherein said upper fixing plate is a rectangular plate, thereby being configured under said billiard table; and said lower fixing plate is curved plate, thereby being configured on said fixing seat of said bearing bracket.

* * * * *